United States Patent [19]

Peche et al.

[11] Patent Number: 4,497,990

[45] Date of Patent: Feb. 5, 1985

[54] VACUUM SWITCH TUBE

[75] Inventors: Gerhard Peche, Romrod; Günter Bialkowski, Berlin, both of Fed. Rep. of Germany

[73] Assignee: Siemens Aktiengesellschaft, Berlin and Munich, Fed. Rep. of Germany

[21] Appl. No.: 488,187

[22] Filed: Apr. 25, 1983

[30] Foreign Application Priority Data

Apr. 30, 1982 [DE] Fed. Rep. of Germany ..... 3216251

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,082,307 | 3/1963 | Greenwood et al. | 200/144 B |
| 3,131,276 | 4/1964 | Watson | 200/144 B |
| 3,166,658 | 1/1965 | Jennings | 200/144 B |
| 3,189,715 | 6/1965 | Jennings | 200/144 B |
| 3,196,236 | 7/1965 | Jennings | 200/144 B |
| 3,261,953 | 7/1966 | Tilman et al. | 200/144 B |
| 4,394,554 | 7/1983 | Warabi et al. | 200/144 B |

FOREIGN PATENT DOCUMENTS

| | | | |
|---|---|---|---|
| 292339 | 7/1965 | Netherlands | 200/144 B |
| 217481 | 7/1968 | U.S.S.R. | 200/144 B |

*Primary Examiner*—Robert S. Macon

*Attorney, Agent, or Firm*—Herbert L. Lerner; Laurence A. Greenberg

[57] ABSTRACT

Vacuum switch tube, including a housing, a stationary and an axially movable contact being mutually aligned in the housing, a bellows vacuum-tightly connecting the movable contact to the housing, a stud bolt being connected to the stationary contact for mounting the switch tube, a ceramic tube being connected to the housing and having a given breaking pressure, a flange being concentric with the stud bolt, the flange being mechanically fixed and vacuum-tightly connected with the stud bolt, the flange being resiliently and vacuum-tightly connected with the ceramic tube for carrying the housing, and the flange being formed of a ring being easily elastically deformable in axial direction, a cylindrical wall being integral with the ring and a soldering flange integral with the cylindrical wall, and a hard solder connection with a given breaking pressure connecting the soldering flange to the ceramic tube, the flange having a modulus of elasticity permitting the flange to be elastically deformed upon the exertion of pressure on the ceramic tube in axial direction and perpendicular to axial direction and preventing the breaking force of the ceramic tube and the solder connection from being reached during the elastic deformation.

6 Claims, 4 Drawing Figures

VACUUM SWITCH TUBE

Figure 1:
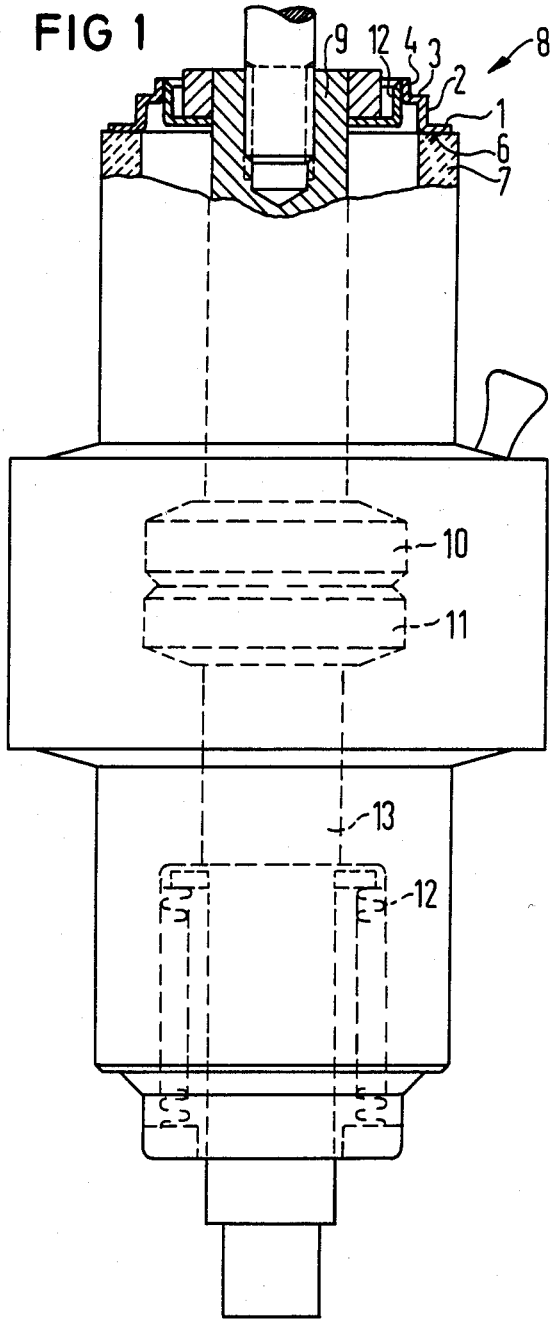

The invention relates to a vacuum switch tube with a stationary and a movable contact, in which the stationary contact has a stud bolt, which is provided with a device for mounting the tube, a concentrically disposed flange is mechanically fixed and vacuum-tightly connected with the stud bolt, the flange is elastically and vacuum-tightly connected with a ceramic tube, the flange carries the entire housing of the vacuum switch tube through the ceramic tube, the two contacts are mutually aligned, and the movable contact moves in axial direction and is vacuum-tightly connected with the housing through a bellows.

A vacuum switch tube of this type is known from U.S. Pat. No. 3,231,704, in which the flange is connected to a ceramic tube of the housing by an elastic ring. The elastic ring is formed of a soldering flange and an adjoining cylindrical casing. The cylindrical casing compensates various changes in shape resulting from heat fluctuations, wherein by virtue of its small wall thickness, the soldering flange follows changes in the dimensions of the ceramic tube.

U.S. Pat. No. 3,082,307 discloses corrugated coupling flanges for attaching the ceramic tube to a stud bolt of a vacuum switch tube. However, this patent contains no mention of an elastic connection between the stud bolt and the housing.

It is accordingly an object of the invention to provide a vacuum switch tube which overcomes the hereinafore-mentioned disadvantages of the heretofore-known devices of this general type, and to increase the starting or switch-on current strength of such vacuum switch tubes.

With the foregoing and other objects in view there is provided, in accordance with the invention, a vacuum switch tube, including a housing, a stationary and an axially movable contact being mutually aligned in the housing, a bellows vacuum-tightly connecting the movable contact to the housing, a stud bolt being connected to the stationary contact with a device for mounting the switch tube, a ceramic tube being connected to the housing and having a given breaking pressure, a flange being concentric with the stud bolt, the flange being mechanically fixed and vacuum-tightly connected with the stud bolt, the flange being resiliently and vacuum-tightly connected with the ceramic tube for carrying the housing, and the flange being formed of a ring being easily elastically deformable in axial direction, a cylindrical wall being integral with or joined to the ring and a soldering flange integral with or joined to the cylindrical wall, and a hard solder connection with a given breaking pressure connecting the soldering flange to the ceramic tube, the flange having a modulus of elasticity permitting the flange to be elastically deformed upon the exertion of pressure on the ceramic tube in axial direction and perpendicular to axial direction and preventing the breaking force of the ceramic tube and the solder connection from being reached during the elastic deformation.

In practice very high starting currents lead to the destruction of the tube housing. This invention is based on the recognition that this destruction of the housing is caused by reciprocal relative lateral movement of the two contacts and by the associated lateral pressure on the housing. Attempts to absorb such forces by arranging rigid support of the contacts in appropriate pole shoes has led to very expensive constructions. By contrast, the present invention represents a considerable simplification in construction which nevertheless, even over the long term, ensures the maintenance of the vacuum in the vacuum switch tube. The invention is based on the recognition that it is necessary to eliminate the effect of the solder metal on the properties of the elastic material. This was achieved by a cylindrical part which adjoins the soldering flange and as a result of its cylindrical form and its associated rigidity it undergoes no noticeable deformation in the event of bending stress or stress in the axial direction of the switch tube. In this region disturbance to the metal lattice and in particular embrittlement is non-critical. In practice only the ring which is easily elastically deformable is deformed.

This is adjoined by a further cylindrical part of the flange which can be welded to a further housing part. In the case of the weld connection, the metal lattice is not subjected to harmful influence since no different metal is incorporated into the metal grid lattice. Accordingly, this cylindrical part can be relatively small.

The embodiments of vacuum switch tube according to the invention are relatively insensitive to longitudinal oscillations or vibrations and bending oscillations or vibrations which can occur as a result of a switching operation. Therefore, when it is installed in a power switch it requires a substantially lower expenditure for attenuation of switch pole oscillations or vibrations.

In accordance with another feature of the invention the elastically deformable ring is flat. This provides optimum mobility in both longitudinal directions.

In accordance with a further feature of the invention the elastically deformable ring is in the form of a truncated cone.

In accordance with an additional feature of the invention the truncated cone has a large and a small end surface, and the small end surface or frustrum is disposed closer to the soldering joint. In this way, the forces on the coupling arising due to the vacuum are absorbed in the form of tensile stress by the coupling.

In accordance with an added feature of the invention the easily elastically deformable ring has first and second sides, the first side being integral with the cylindrical wall, and including a cylindrical part being integral with the easily elastically deformable ring at the second side thereof, and a housing ring being attached to the stud bolt and being vacuum-tightly welded to the housing ring.

In accordance with concomitant feature of the invention the first side is the outer border and the second side is the inner border of the easily elastically deformable ring, and the flange includes a smoothly or steadily curved transition region from the ring to the cylindrical part, covering substantially half the distance between the cylindrical wall and the cylindrical part.

Other features which are considered as characteristic for the invention are set forth in the appended claims.

Although the invention is illustrated and described herein as embodied in a vacuum switch tube, it is nevertheless not intended to be limited to the details shown, since various modifications and structural changes may be made therein without departing from the spirit of the invention and within the scope and range of equivalents of the claims.

Figure 2:
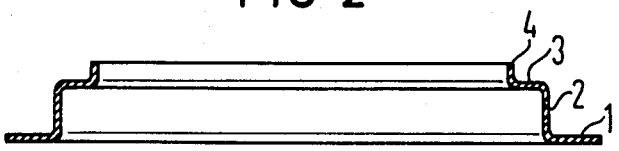
Figure 3:
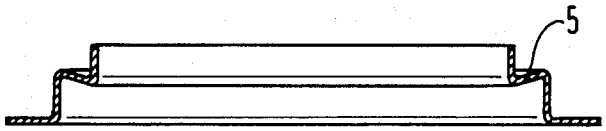
Figure 4:
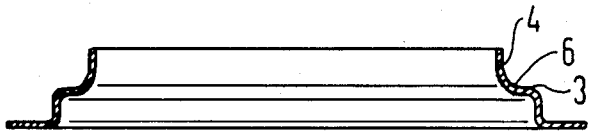

The construction and method of operation of the invention, however, together with additional objects and advantages thereof will be best understood from the following description of specific embodiments when read in connection with the accompanying drawings, in which:

FIG. 1 is a fragmentary, diagrammatic side elevational view of a switch tube according to the invention, being partly broken away and partly sectional; and FIGS. 2 to 4 are cross-sectional views of embodiments of flanges according to the invention.

Referring now to the figures of the drawing in detail and first particularly to FIG. 1 thereof, there is seen a vacuum switch having two mutually-aligned contacts 10 and 11, the stationary contact of which is attached to a stud bolt 9. The stud bolt 9 is attached through a housing ring 12 to a resilient flange 8 which carries a ceramic ring 7 and thus carries the entire housing of the vacuum switch tube.

The resilient flange 8 is formed of a soldering flange 1, a cylindrical wall 2, a ring 3 which is easily elastically deformable, and a cylindrical portion or part 4. The soldering flange 1 is hard soldered to a metalized end surface 6 of the ceramic tube 7. Advantageously, an AgCu eutectic serves as the solder. By virtue of its shape, the cylindrical wall 2 remains stiff in the event of oscillations or vibrations of the housing along or perpendicular to, the axial direction of the housing. In this way, the cylindrical wall 2 does not noticeably participate in these oscillations or vibrations, and disturbance of its lattice structure due to the presence of the solder does not impair the service life of the tube, even when this results in embrittlement of the material at least in the region which adjoins the soldered flange. The elastic, easily deformable ring 3 remains free of such disturbances to the lattice structure. The adjoining cylindrical portion 4 is welded to the housing ring 12. As a result no disturbance occurs in the lattice structure since in the case of welding, in contrast to soldering, no foreign metals are supplied. In addition, the welding advantageously only takes place in the end region of the ring 12, and the remaining, non-welded part of the ring 12 additionally provides a spacing for the elastically deformable ring.

The movable contact 11 is vacuum-tightly connected to the housing by a bolt 13 and a bellows 12.

The elastic, easily deformable ring 3 is flat according to the embodiment of FIG. 2. In this way, the ring 3 provides especially large mobility in the axial directions. According to FIG. 3, the elastic, easily deformable ring 5 is in the form of a truncated cone, so that the surface having the smaller cross section of the truncated cone is closer to the soldering flange 1. With this embodiment, pressure forces exerted on the housing as a result of the vacuum prevailing inside the tube, are absorbed as tensile stress. This embodiment permits an especially thin wall thickness of the flange 8.

According to the embodiment of FIG. 4, the junction from the elastic, easily deformable ring 3 to the cylindrical portion 4, which adjoins the inner boundary of the elastic, easily deformable ring 3, forms a steadily curved region 6, which covers approximately half the distance between the cylindrical wall 2 and the cylindrical portion 4. The curved region 6 has an arcuate or circular cross section. This embodiment has proved particularly stable and advantageous upon the occurrence of oscillations or vibrations.

The foregoing is a description corresponding, in substance, to German Application No. P 32 16 251.0, dated Apr. 30, 1982, international priority of which is being claimed for the instant application, and which is hereby made part of this application. Any material discrepancies between the foregoing specification and the specification of the aforementioned corresponding German application are to be resolved in favor of the latter.

There are claimed:

1. Vacuum switch tube, comprising a housing, a stationary and an axially movable contact being mutually aligned in said housing, a bellows vacuum-tightly connecting said movable contact to said housing, a stud bolt being connected to said stationary contact for mounting the switch tube, a ceramic tube being connected to said housing and having a given breaking pressure, a flange being concentric with said stud bolt, said flange being mechanically fixed and vacuum-tightly connected with said stud bolt, said flange being resiliently and vacuum-tightly connected with said ceramic tube for carrying said housing, and said flange being formed of a ring being easily elastically deformable in axial direction, a cylindrical wall being integral with said ring and a soldering flange integral with said cylindrical wall, a hard solder connection with a given breaking pressure connecting said soldering flange to said ceramic tube, said flange having a modulus of elasticity permitting said flange to be elastically deformed upon the exertion of pressure on said ceramic tube in axial direction and perpendicular to axial direction and preventing the breaking force of said ceramic tube and said solder connection from being reached during said elastic deformation, said easily elastically deformable ring having first and second sides, said first side being integral with said cylindrical wall, and including a cylindrical part being integral with said easily elastically deformable ring at said second side thereof, and a housing ring being attached to said stud bolt and being vacuum-tightly welded to said cylindrical part.

2. Vacuum switch tube according to claim 1, wherein said elastically deformable ring is flat.

3. Vacuum switch tube according to claim 1, wherein said elastically deformable ring is in the form of a truncated cone.

4. Vacuum switch tube according to claim 3, wherein the truncated cone has a large and a small end surface, and the small end surface is disposed closer to the soldering point.

5. Vacuum switch tube according to claim 1, wherein said first side is the outer border and the second side is the inner border of said easily elastically deformable ring, and said flange includes a steadily curved transition region from said ring to said cylindrical part, covering substantially half the distance between said cylindrical wall and said cylindrical part.

6. In a vacuum switch tube including a housing, a stationary and a movable contact disposed in said housing, a stud bolt being connected to said stationary contact, and a ceramic tube connected to said housing, the improvement comprising a flange connected between said stud bolt and said ceramic tube, said flange being formed of a ring, a cylindrical wall integral with said ring and a soldering flange integral with said cylindrical wall, a hard solder connection connecting said soldering flange to the ceramic tube, said ring being elastically deformable for cushioning the ceramic tube and said solder connection against pressures exerted on the ceramic tube, said easily elastically deformable ring having first and second sides, said first side being integral with said cylindrical wall, and including a cylindrical part being integral with said easily elastically deformable ring at said second side thereof, and a housing ring being attached to said stud bolt and being vacuum-tightly welded to said cylindrical part.

* * * * *